US010695791B2

(12) United States Patent
Atsebha

(10) Patent No.: US 10,695,791 B2
(45) Date of Patent: Jun. 30, 2020

(54) METHODS FOR APPLYING VISCOUS MATERIAL TO A FASTENER

(71) Applicant: The Boeing Company, Chicago, IL (US)

(72) Inventor: Solomon T. Atsebha, Seattle, WA (US)

(73) Assignee: The Boeing Company, Chicago, IL (US)

( * ) Notice: Subject to any disclaimer, the term of this patent is extended or adjusted under 35 U.S.C. 154(b) by 240 days.

(21) Appl. No.: 15/787,251

(22) Filed: Oct. 18, 2017

(65) Prior Publication Data

US 2018/0056323 A1 Mar. 1, 2018

Related U.S. Application Data

(62) Division of application No. 14/471,446, filed on Aug. 28, 2014, now Pat. No. 9,827,587.

(51) Int. Cl.

| | |
|---|---|
| ***B05C 17/005*** | (2006.01) |
| ***B65D 35/28*** | (2006.01) |
| ***B05C 17/015*** | (2006.01) |

(52) U.S. Cl.

CPC .. *B05C 17/00573* (2013.01); *B05C 17/00516* (2013.01); *B05C 17/00583* (2013.01); *B05C 17/015* (2013.01); *B65D 35/28* (2013.01)

(58) Field of Classification Search

CPC ..... B05C 17/00573; B05C 17/00516; B05C 17/00583; B05C 17/015; B65D 35/28

See application file for complete search history.

(56) References Cited

U.S. PATENT DOCUMENTS

| | | | | |
|---|---|---|---|---|
| 3,712,516 A * | 1/1973 | Stamets | B05C 17/015 | 222/326 |
| 4,302,271 A * | 11/1981 | Injerd | B05C 7/06 | 141/1 |
| 4,925,061 A * | 5/1990 | Jeromson, Jr. | B05C 17/015 | 222/1 |
| 5,029,738 A * | 7/1991 | Dillon | B05C 17/00516 | 222/215 |
| 5,654,041 A | 8/1997 | Appich et al. | | |

(Continued)

OTHER PUBLICATIONS

Home Improvement, StackExchange, found at https://diy.stackexchange.com/questions/10078/should-i-use-caulk-or-wood-putty-and-paint-to-fill-nail-holes-on-trim, Dec. 9, 2011.*

*Primary Examiner* — James M Mellott

(74) *Attorney, Agent, or Firm* — Miller, Matthias & Hull LLP

(57) ABSTRACT

A method of applying a viscous material to a fastener comprises aligning a nozzle relative to the fastener by engaging an aligner with the fastener. Engaging the aligner with the fastener comprises positioning the aligner over the fastener and advancing a biasing tube toward the fastener to establish contact between the aligner and a structure to partially retract the aligner into the biasing tube until a plurality of surfaces of the aligner contacts one or more outer surfaces of the fastener. A flexible wall of a dispenser bellows is deflected by expanding a pressure-application device, which is configured to apply pressure on the flexible wall of the dispenser bellows, wherein the dispenser bellows is in fluid communication with the nozzle. The viscous material is expelled from the dispenser bellows responsive to deforming the flexible wall.

20 Claims, 14 Drawing Sheets

(56) References Cited

U.S. PATENT DOCUMENTS

| | | | |
|---|---|---|---|
| 6,067,906 | A | 5/2000 | Ryan et al. |
| 7,669,783 | B2 | 3/2010 | Fischer et al. |
| 2005/0227014 | A1 | 10/2005 | Motomura |
| 2011/0311730 | A1 | 12/2011 | Atsebha et al. |
| 2012/0273115 | A1 | 11/2012 | Suzuki et al. |

* cited by examiner

METHODS FOR APPLYING VISCOUS MATERIAL TO A FASTENER

BACKGROUND

Aircraft and other vehicles utilize fasteners in fuel tanks and other areas in which electromagnetic effect (EME) phenomena, e.g. lightning strikes, are a concern. To protect against EME phenomena, seals are conventionally installed over the fasteners to satisfy electrical-insulation and other sealing requirements. Regulations provide specific parameters for the geometry and consistency of such seals.

Manually applying the sealant with a conventional daubing gun may result in non-uniform seals containing varying volumes of sealant. Moreover, conventional daubing guns used to apply the sealant often utilize compressed air for sealant ejection. The compressed air may mix with the sealant, introducing air bubbles into the sealant. Air bubbles remaining in the sealant after curing create voids that negatively affect the EME protection capabilities of the seal, requiring replacement or correction.

Seal caps are often used instead of manually applying the sealant. Seal caps include exterior shells filled with viscous sealant. Each seal cap is pressed over a fastener until sealant is squeezed out of the shell. Squeeze out must be removed or smoothed, which increases cycle time and potential for time-consuming rework. Moreover, air may become trapped underneath the shell, which is undesirable for the reasons explained above.

SUMMARY

Accordingly, apparatuses and methods, intended to address the above-identified concerns, would find utility.

The following is a non-exhaustive list of examples, which may or may not be claimed, of the subject matter according the present disclosure.

One example of the present disclosure relates to a daubing device for applying a viscous material to a fastener. The daubing device comprises a housing comprising a first internal face and a second internal face, separated from the first internal face by a longitudinal distance L. The daubing device further comprises a dispenser between the first internal face and the second internal face of the housing. The dispenser comprises a flexible wall. The daubing device also comprises a pressure-application device between the dispenser and the second internal face of the housing.

Another example of the present disclosure relates to a method of applying a viscous material to a fastener. The method comprises deforming a flexible wall of a dispenser located within a housing by expanding a pressure-application device within the housing. The method further comprises expelling viscous material from the dispenser responsive to deforming the flexible wall of the dispenser located within the housing.

BRIEF DESCRIPTION OF THE DRAWINGS

Having thus described examples of the present disclosure in general terms, reference will now be made to the accompanying drawings, which are not necessarily drawn to scale, and wherein like reference characters designate the same or similar parts throughout the several views, and wherein:

FIG. 1 is a block diagram of a daubing device for applying viscous material over a fastener;

FIG. 2A is a schematic sectional side view of the daubing device of FIG. 1 showing a dispenser comprising a pouch and a pressure-application device comprising a balloon mechanism, according to one or more examples of the present disclosure;

FIG. 2B is a schematic sectional side view of the daubing device of FIG. 1 showing a dispenser comprising dispenser bellows and a pressure-application device comprising a balloon mechanism, according to one or more examples of the present disclosure;

FIG. 2C is a schematic sectional side view of the daubing device of FIG. 1 showing a dispenser comprising a pouch and a pressure-application device comprising a pressure-application bellows, according to one or more examples of the present disclosure;

FIG. 2D is a schematic sectional side view of the daubing device of FIG. 1 showing a dispenser comprising dispenser bellows and a pressure-application device comprising a pressure-application bellows, according to one or more examples of the present disclosure;

FIGS. 3A-3C are schematic sectional side views of a housing of the daubing device of FIG. 1, illustrating various dimensional aspects of a dispenser and a pressure-application device of the daubing device according to one or more examples of the present disclosure;

FIGS. 4A and 4B are schematic sectional side views of a nozzle of the daubing device of FIG. 1 in distended and compressed configurations, respectively, showing means for expanding the nozzle according to one or more examples of the present disclosure;

FIGS. 5A and 5B are schematic sectional side views of a nozzle of the daubing device of FIG. 1 in distended and compressed configurations, respectively, showing alternative means for expanding the nozzle according to one or more examples of the present disclosure;

FIGS. 6A and 6B are schematic sectional side views of a pressure-application bellows of the daubing device of FIG. 1 in collapsed and distended states, respectively, showing means for retracting the pressure-application bellows according to one or more examples of the present disclosure;

FIGS. 7A and 7B are schematic sectional side views of a pressure-application bellows of the daubing device of FIG. 1 in collapsed and distended states, respectively, showing alternative means for retracting the pressure-application bellows according to one or more examples of the present disclosure;

FIGS. 8A-8C are schematic sectional side views of the daubing device of FIG. 1 in operation according to one or more examples of the present disclosure;

Figure 1:
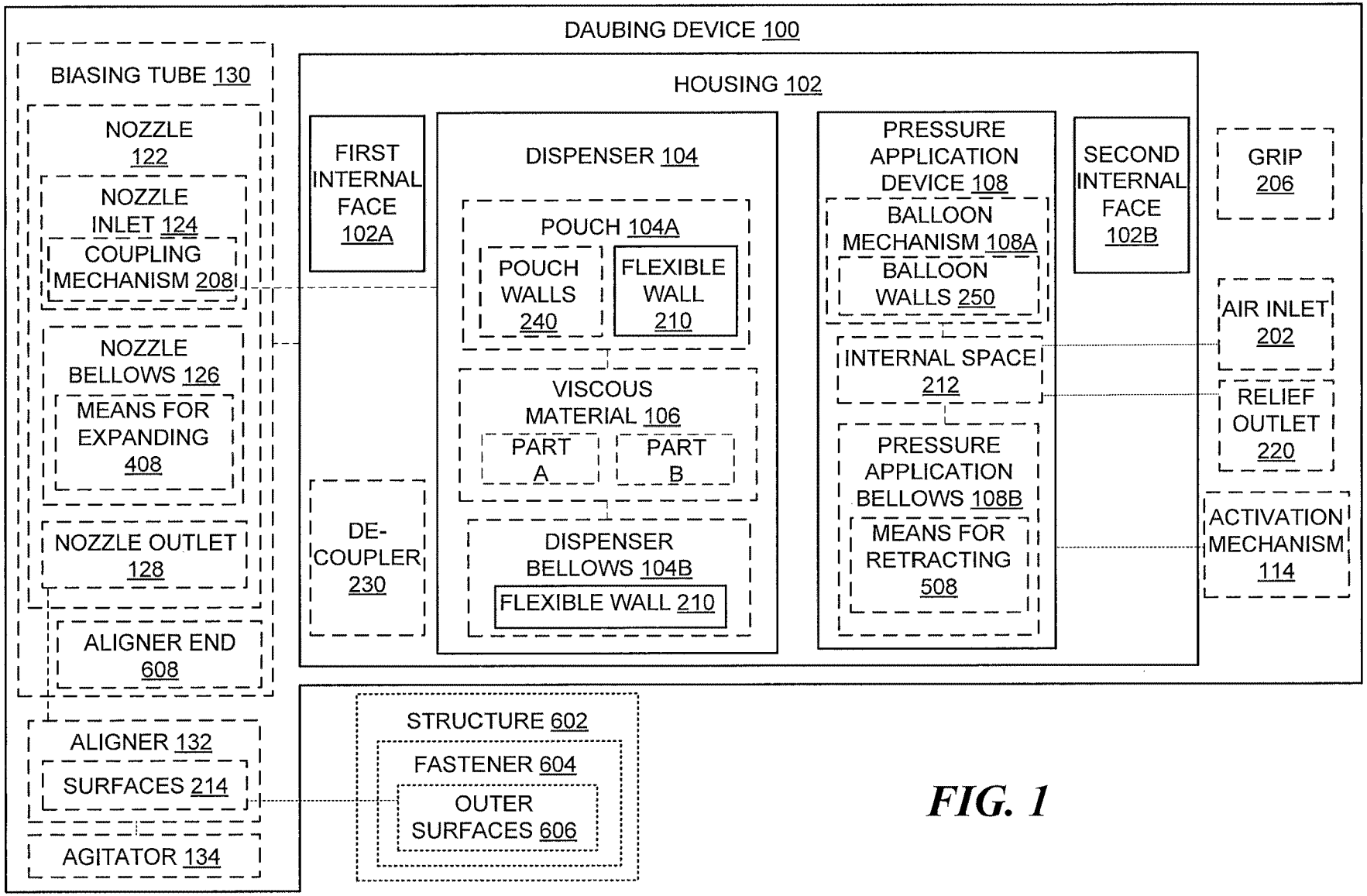
Figure 9:
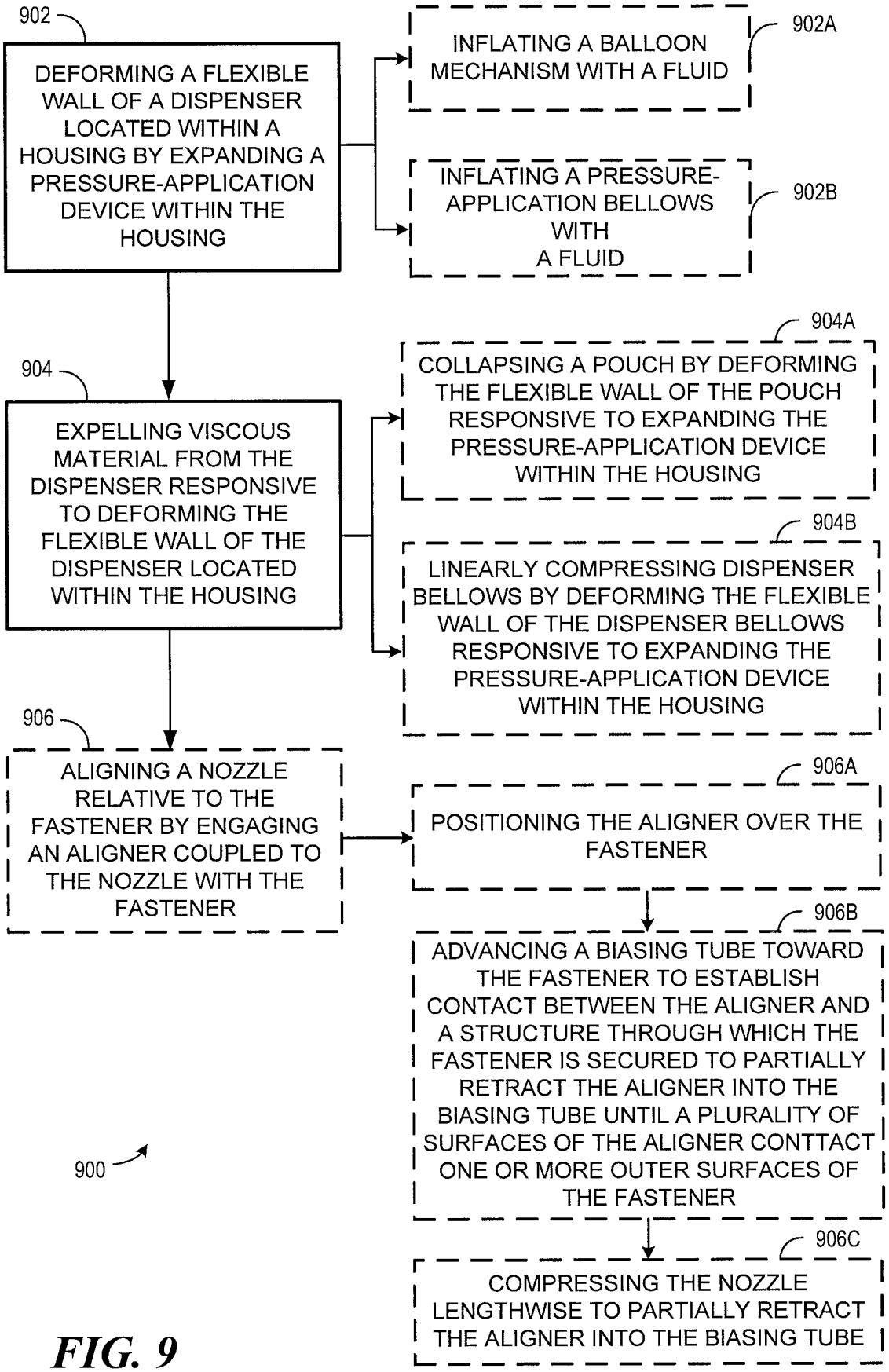
Figure 10:
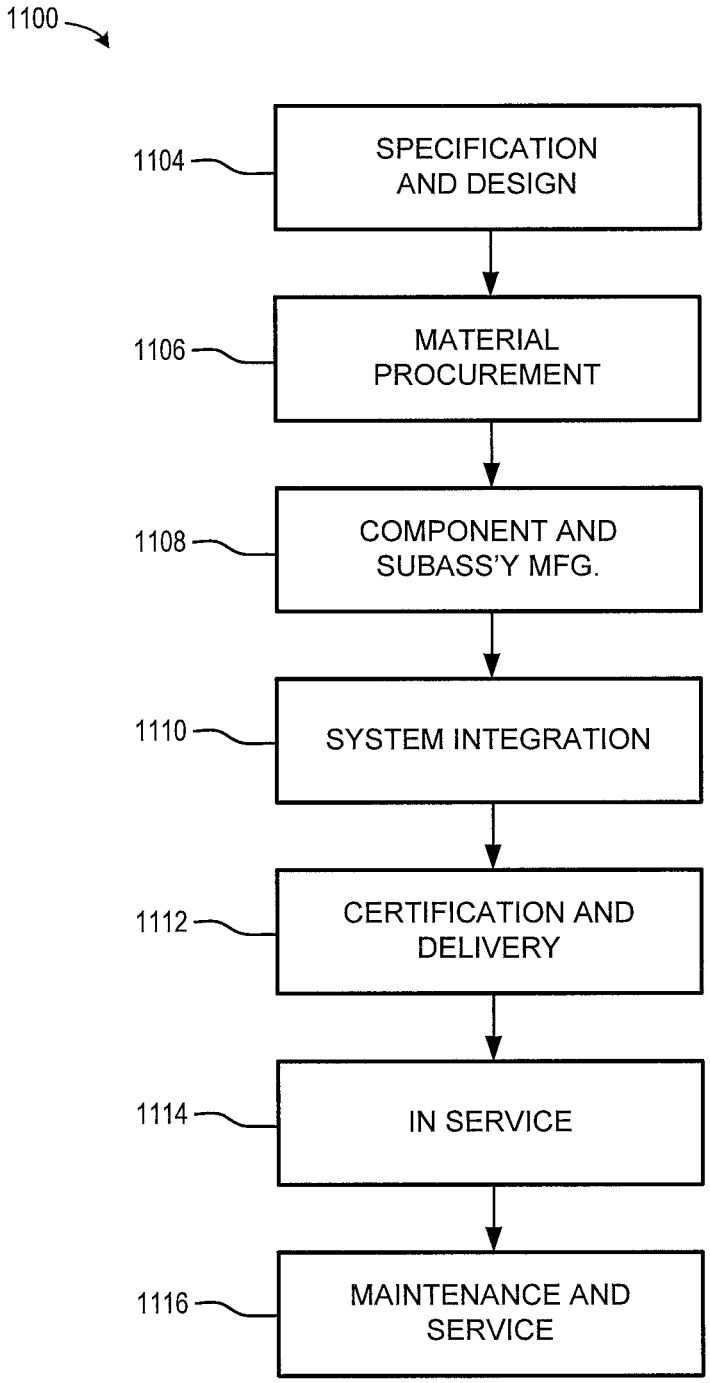
Figure 11:
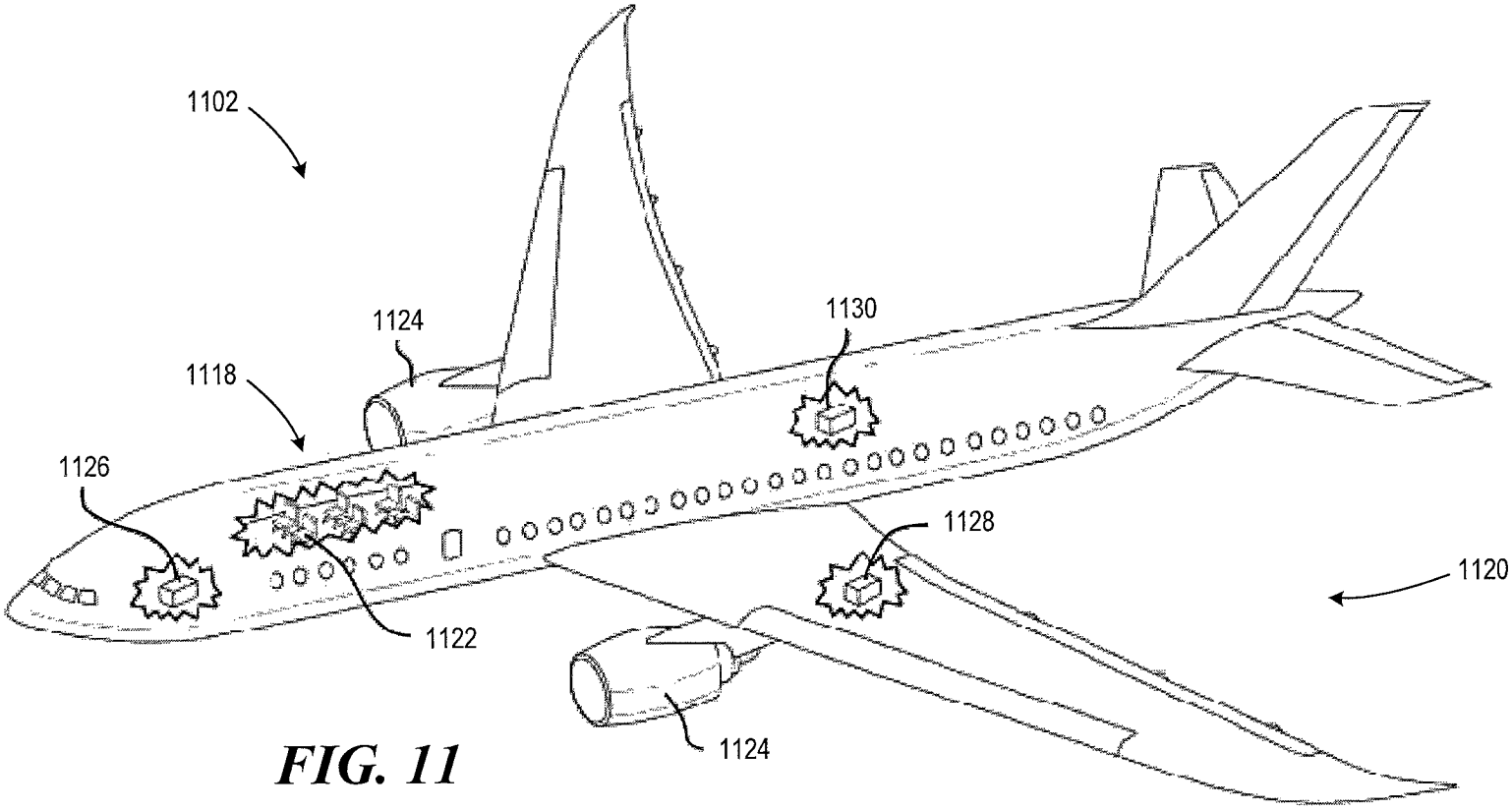

FIG. 9 is a block diagram of a method of utilizing the daubing device of FIG. 1 to apply viscous material to a fastener, according to one or more examples of the present disclosure;

FIG. 10 is a block diagram of aircraft production and service methodology; and FIG. 11 is a schematic illustration of an aircraft.

DETAILED DESCRIPTION

In FIG. 1, referred to above, solid lines, if any, connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. It will be understood that not all relationships between the various disclosed elements are necessarily represented. Accordingly, couplings other than those depicted in the block diagrams may also exist. Dashed lines, if any, connecting the various elements and/or components represent couplings similar in function and purpose to those represented by solid lines; however, couplings represented by the dashed lines may either be selectively provided or may relate to alternative or optional examples of the present disclosure. Likewise, elements and/or components, if any, represented with dashed lines, indicate alternative or optional examples of the present disclosure. Environmental elements, if any, are represented with dotted lines. Virtual (imaginary) elements may also be shown for clarity. Those skilled in the art will appreciate that some of the features illustrated in FIG. 1 may be combined in various ways without the need to include other features described in FIG. 1, other drawing figures, and/or the accompanying disclosure, even though such combination or combinations are not explicitly illustrated herein. Similarly, additional features not limited to the examples presented, may be combined with some or all of the features shown and described herein.

In FIGS. 9 and 10, referred to above, the blocks may represent operations and/or portions thereof and lines connecting the various blocks do not imply any particular order or dependency of the operations or portions thereof. FIGS. 9 and 10 and the accompanying disclosure describing the operations of the method(s) set forth herein should not be interpreted as necessarily determining a sequence in which the operations are to be performed. Rather, although one illustrative order is indicated, it is to be understood that the sequence of the operations may be modified when appropriate. Accordingly, certain operations may be performed in a different order or simultaneously. Additionally, those skilled in the art will appreciate that not all operations described need be performed.

In the following description, numerous specific details are set forth to provide a thorough understanding of the disclosed concepts, which may be practiced without some or all of these particulars. In other instances, details of known devices and/or processes have been omitted to avoid unnecessarily obscuring the disclosure. While some concepts will be described in conjunction with specific examples, it will be understood that these examples are not intended to be limiting.

Reference herein to "one example" means that one or more feature, structure, or characteristic described in connection with the example is included in at least one implementation. The phrase "one example" in various places in the specification may or may not be referring to the same example.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

Illustrative, non-exhaustive examples, which may or may not be claimed, of the subject matter according the present disclosure are provided below.

Referring e.g., to FIGS. 1, 2A-2D, and 8A-8C, the instant paragraph pertains to example 1 of the present disclosure. Example 1 relates to daubing device 100 for applying viscous material to fastener 604. Daubing device 100 comprises housing 102 comprising first internal face 102A and second internal face 102B, separated from first internal face 102A by longitudinal distance L. Daubing device 100 further comprises dispenser 104 between first internal face 102A and second internal face 102B of housing 102. Dispenser 104 comprises flexible wall 210. Daubing device also comprises pressure-application device 108 between dispenser 104 and second internal face 102B of housing 102.

Dispenser 104 contains viscous material 106. Viscous material 106 may be, for example, Polysulfide or comparable sealant such as PR-1776, a Class B, low weight, fuel tank sealant commercially available from PRC-DeSoto International, Inc., 12780 San Fernando Road, Sylmar, Calif. 91342. Viscous material 106 may include two or more parts, such as Part A and Part B, which are pre-mixed and inserted into dispenser 104. When filling dispenser 104 with viscous material 106 for use with daubing device 100, a vacuum may be applied to dispenser 104 to remove all air from within dispenser 104 so that only viscous material 106 remains. Removing air from the dispenser 104 ensures continuity and consistency of the viscous material 106 when applied to a fastener 604 in order to prevent voids from forming in viscous material 106 when cured.

Dispenser 104 and pressure-application device 108 are linearly arranged adjacent to one another between first internal face 102A and second internal face 102B of housing 102. Flexible wall 210 of dispenser 104 allows for compression of at least a portion of dispenser 104 in response to a force applied by pressure-application device 108. Upon expansion of pressure-application device 108, flexible wall 210 moves, collapses, or stretches. Due to the physical constraints of the walls (including first internal face 102A and second internal face 102B) of housing 102, an internal volume of dispenser 104 decreases as the flexible wall 210 moves, collapses, or stretches, forcing viscous material 106 out of dispenser 104. Referring e.g. to FIGS. 1 and 2A-2D, in various examples of the present disclosure, flexible wall 210 may include all walls of dispenser 104, or may include one or more walls of dispenser 104, such as a wall adjacent to pressure-application device 108.

Referring e.g. to FIGS. 1 and 2A-2D, in one example of the present disclosure, daubing device 100 comprises de-coupler 230. De-coupler 230 may include threads or other suitable coupling or de-coupling mechanism for accessing an interior space of housing 102 for installation and removal of dispenser 104. For example, a user may unscrew a front portion of housing 102 at via threads (de-coupler 230) to install dispenser 104 filled with viscous material 106 prior to using daubing device 100, and subsequently unscrew the de-coupler 230 for removal of dispenser 104 after use of daubing device 100.

Referring e.g. to FIGS. 1, 2A-2D, and 8A-8C, in one example of the present disclosure, housing 102 of daubing device 100 may comprise grip 206. Grip 206 allows a user to efficiently support daubing device 102 while accessing activation mechanism 114 for selectively applying viscous material 106 to one or more fasteners 604.

Figure 3A:
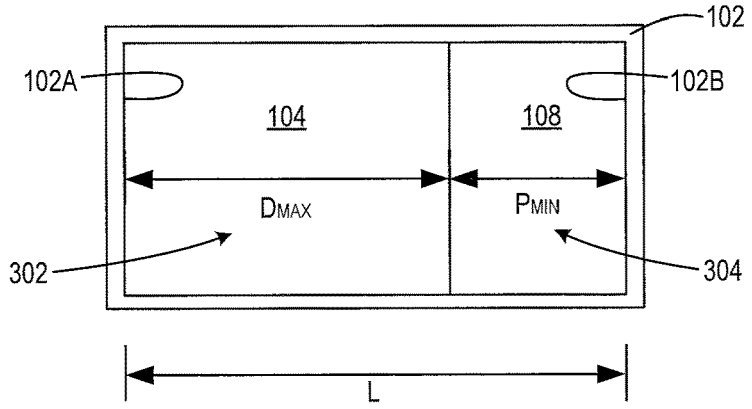
Figure 3B:
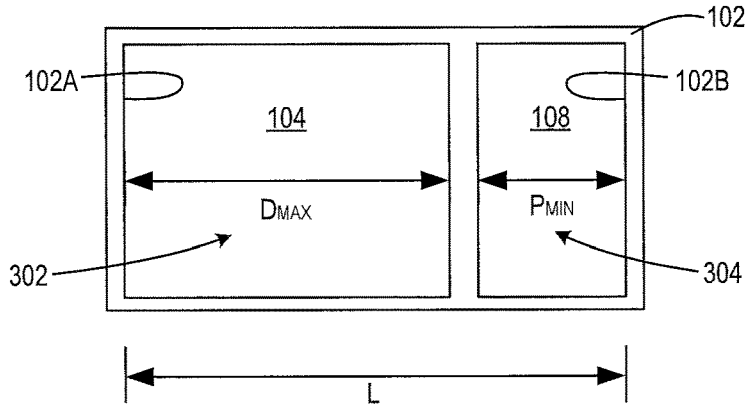
Figure 3C:
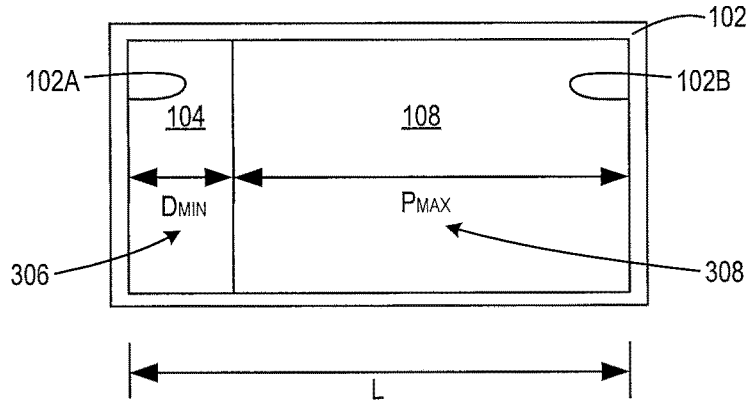

Referring generally to FIG. 1 and particularly to e.g. FIGS. 3A-3C, the instant paragraph pertains to example 2 of the present disclosure. In example 2, which includes the subject matter of example 1, when dispenser 104 is in filled state 302, pressure-application device 108 is in collapsed state 304, and when dispenser 104 is in empty state 306, pressure-application device 108 is in distended state 308. In filled state 302, dispenser 104 has longitudinal dimension $D_{max}$, and in empty state 306, dispenser 104 has longitudinal dimension $D_{min}$. In distended state 308, pressure-application device 108 has longitudinal dimension $P_{max}$, and in collapsed state 304, pressure-application device 108 has longitudinal dimension $P_{min}$. Longitudinal dimension $D_{max}$ is greater than longitudinal dimension $D_{min}$, and longitudinal dimension $P_{max}$ is greater than longitudinal dimension $P_{min}$. A sum of longitudinal dimension $P_{max}$ and longitudinal dimension $D_{min}$, equals longitudinal distance L between first internal face 102A and second internal face 102B (FIG. 3C).

In filled state 302, dispenser 104 contains viscous material 106. With dispenser 104 in filled state 302, pressure-application device 108 is in collapsed state 304, e.g. prior to inflation. Similarly, when pressure-application device 108 is in distended state 308, e.g. after inflation, dispenser 104 is in empty state 306. Empty state 306 may occur when dispenser 104 is at least partially collapsed or compressed, having expelled at least a portion of viscous material 106 from dispenser 104.

Referring generally to FIG. 1 and particularly to e.g. FIG. 3A, the instant paragraph pertains to example 3 of the present disclosure. In example 3, which includes the subject matter of example 2, a sum of longitudinal dimension $D_{max}$ and longitudinal dimension $P_{min}$ equals longitudinal distance L between first internal face 102A and second internal face 102B.

According to this example, dispenser 104 is in filled state 302, such as when dispenser 104 is full of viscous material 106 and loaded into housing 102 of daubing device 100 with longitudinal dimension $D_{max}$. Pressure-application device 108 is in collapsed state 304, having a longitudinal dimension $P_{min}$. In this example, pressure-application device 108 abuts dispenser 104 such that any expansion of pressure-application device 108 applies pressure to dispenser 104 to expel viscous material 106. Activation of pressure-application device 108 via activation mechanism 114 described below will initiate compression of dispenser 104 without any substantial delay since a sum of the longitudinal dimension $P_{min}$ and the longitudinal dimension $D_{max}$ is equivalent to the longitudinal distance L between first internal face 102A and second internal face 102B. An increase to the longitudinal dimension $P_{min}$ initiates a decrease in the longitudinal dimension $D_{max}$.

Referring generally to FIG. 1 and particularly to e.g. FIG. 3B, the instant paragraph pertains to example 4 of the present disclosure. In example 4, which includes the subject matter of example 2, a sum of longitudinal dimension $D_{max}$ and longitudinal dimension $P_{min}$ is less than longitudinal distance L between first internal face 102A and second internal face 102B.

According to this example, pressure-application device 108 is adjacent to, but does not abut, dispenser 104. Air may be removed from internal space 212 of pressure-application device 108 via relief outlet 220 or means 508 for retracting pressure-application device 108 to a degree in which a sum of the longitudinal dimension $D_{max}$ and the longitudinal dimension $P_{min}$ is less than the longitudinal distance L between first internal face 102A and second internal face 102B. One benefit of this example is to allow for simplified installation of dispenser 104 within housing 102 via decoupler 230. As a gap may exist between dispenser 104 and pressure-application device 108 in this example, there is no force from the pressure-application device 108 acting on the dispenser 104 during installation as the housing 102 is threaded together or otherwise coupled.

Figure 2A:
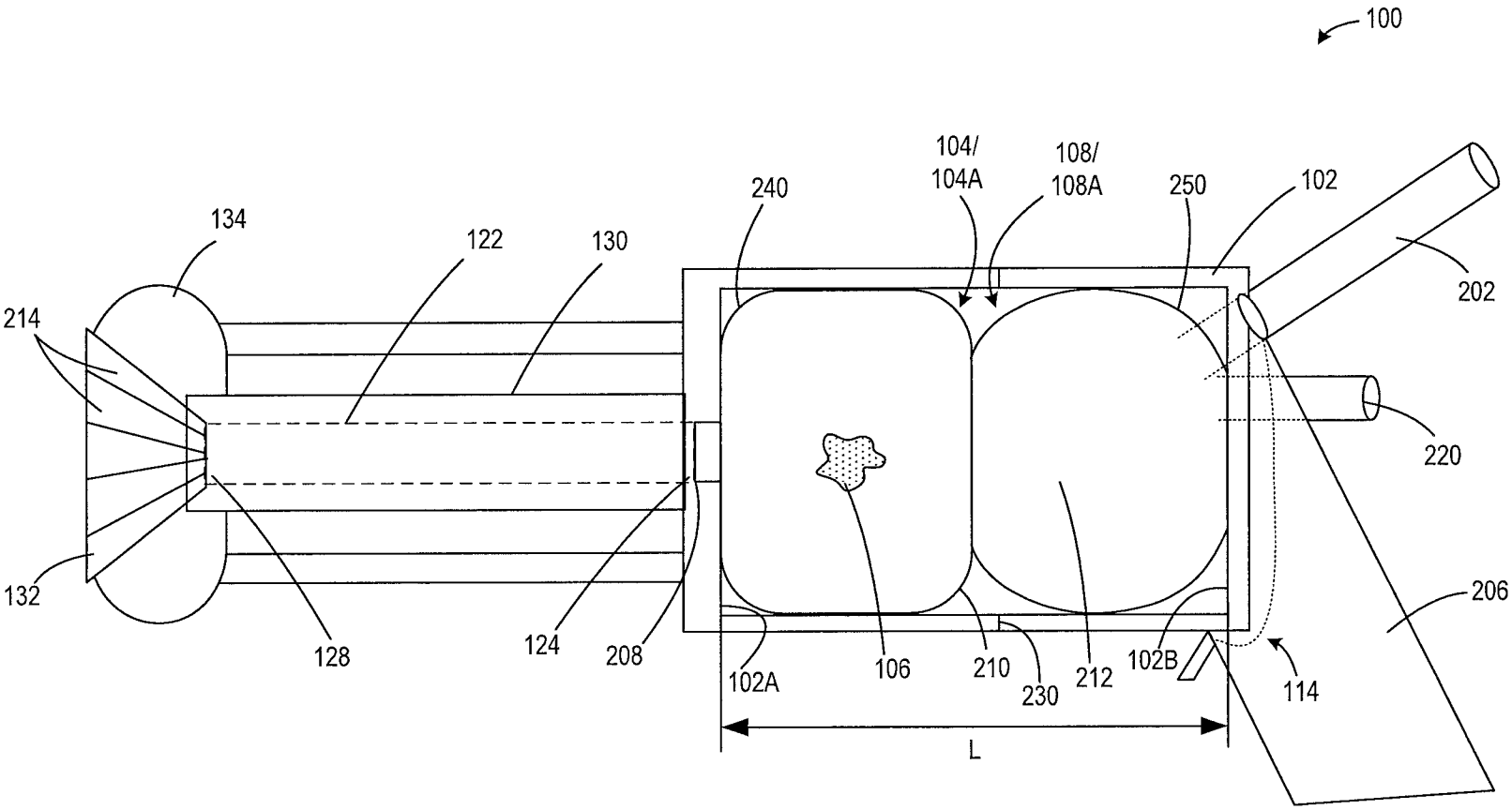
Figure 2B:
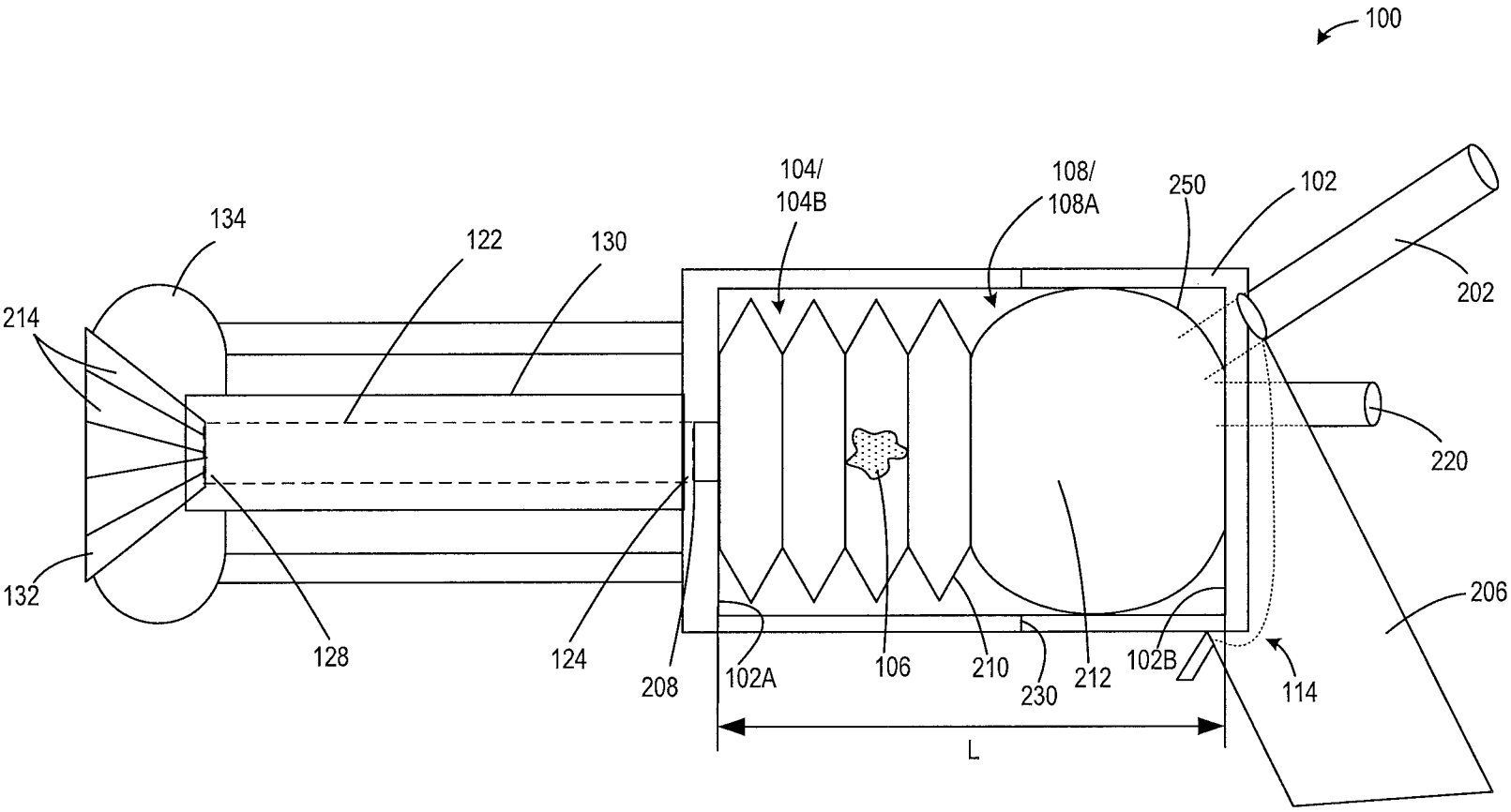
Figure 2C:
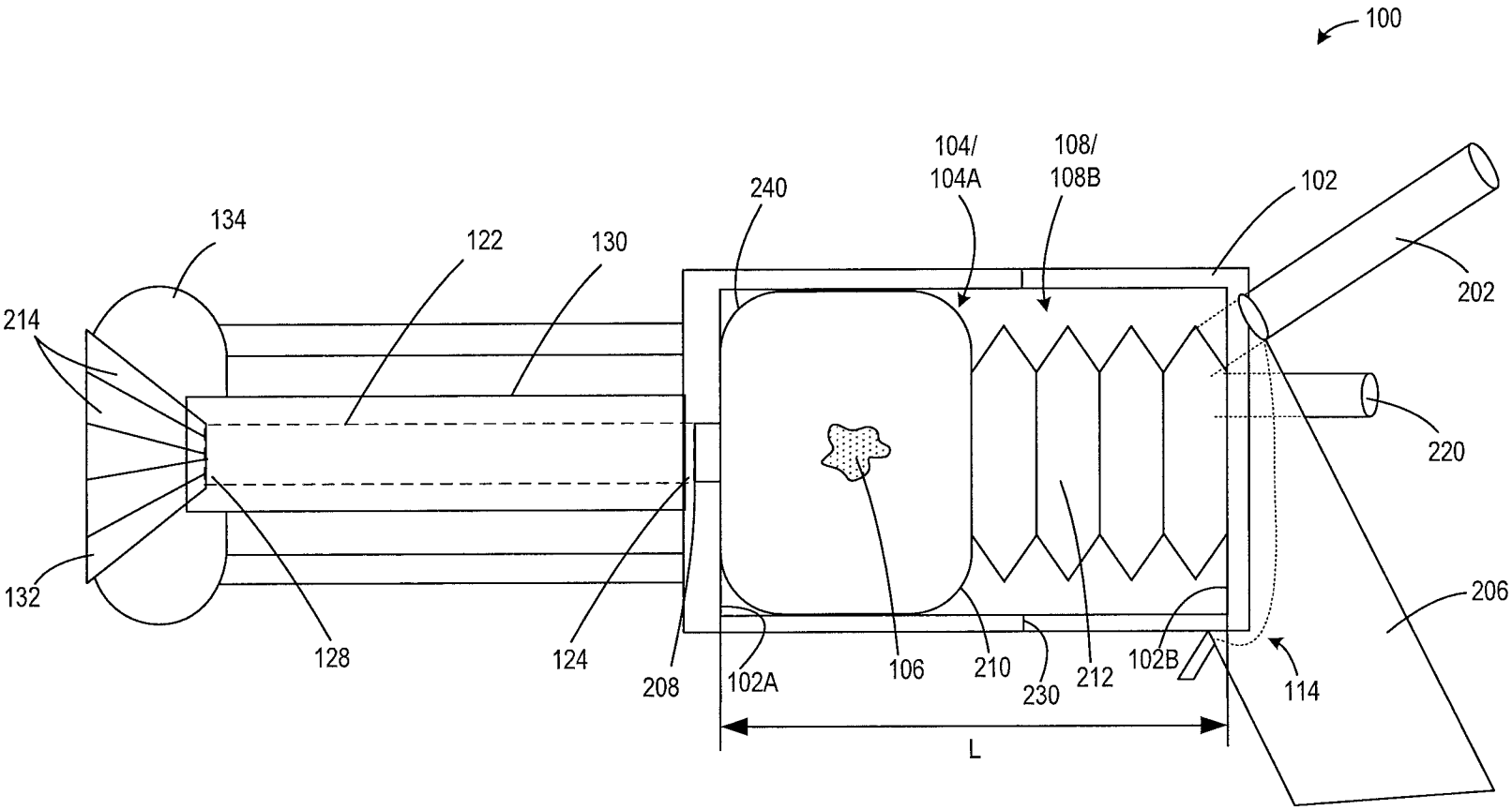
Figure 2D:
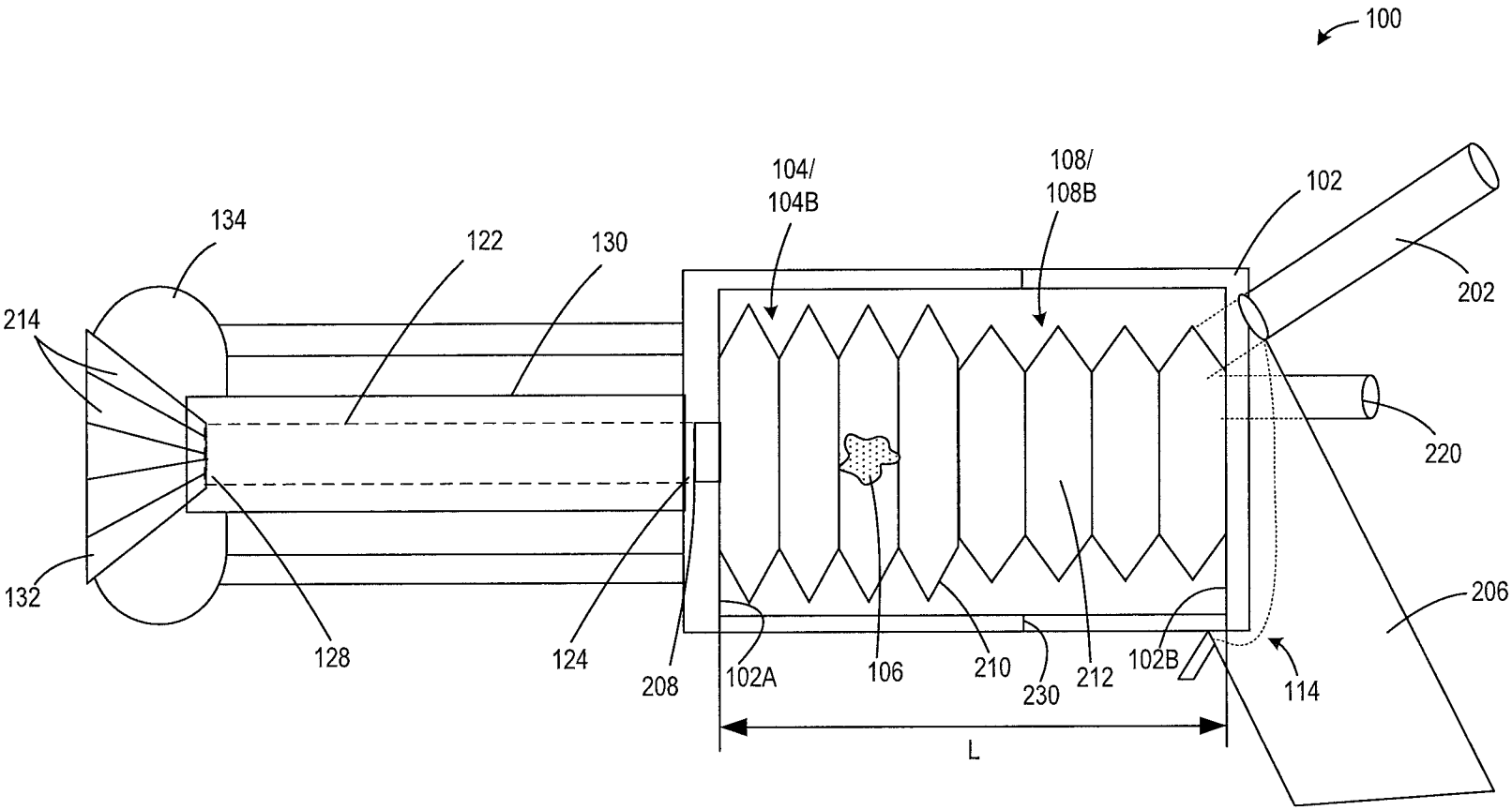

Referring generally to FIGS. 1, 3A-3C, 6A, and 6B, and particularly to e.g. FIGS. 2C and 2D, the instant paragraph pertains to example 5 of the present disclosure. In example 5, which includes the subject matter of any of examples 2-4, pressure-application device 108 comprises pressure-application bellows 108B linearly expandable from longitudinal dimension $P_{min}$ to longitudinal dimension $P_{max}$.

According to this example, pressure-application bellows 108B is linearly expandable within housing 102. By linearly expanding away from the fixed second internal face 102B, pressure-application bellows 108B applies a force against flexible wall 210 of dispenser 104 to compress dispenser 104 against the fixed first internal face 102A and expel viscous material 106 (FIGS. 2C, 2D).

Referring generally to FIG. 1 and particularly to e.g. FIGS. 6A, 6B, 7A and 7B, the instant paragraph pertains to example 6 of the present disclosure. In example 6, which includes the subject matter of example 5, daubing device 100 comprises means 508 for retracting pressure-application bellows 108B from the longitudinal dimension $P_{max}$ to the longitudinal dimension $P_{min}$.

As used herein, means 408 and means 508 are to be interpreted under 35 U.S.C. 112(f), unless otherwise explicitly stated. It should be noted that examples provided herein of any structure, material, or act in support of any means-plus-function clause, and equivalents thereof, may be utilized individually or in combination. Thus, while various structures, materials, or acts may be described in connection with a means-plus-function clause, any combination thereof or of their equivalents is contemplated in support of such means-plus-function clause.

Figure 6A:
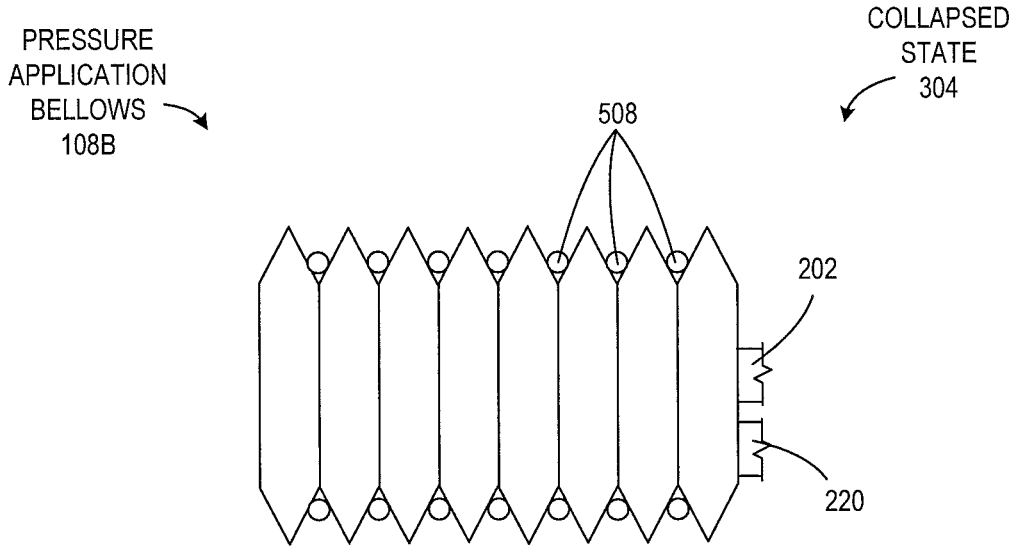
Figure 6B:
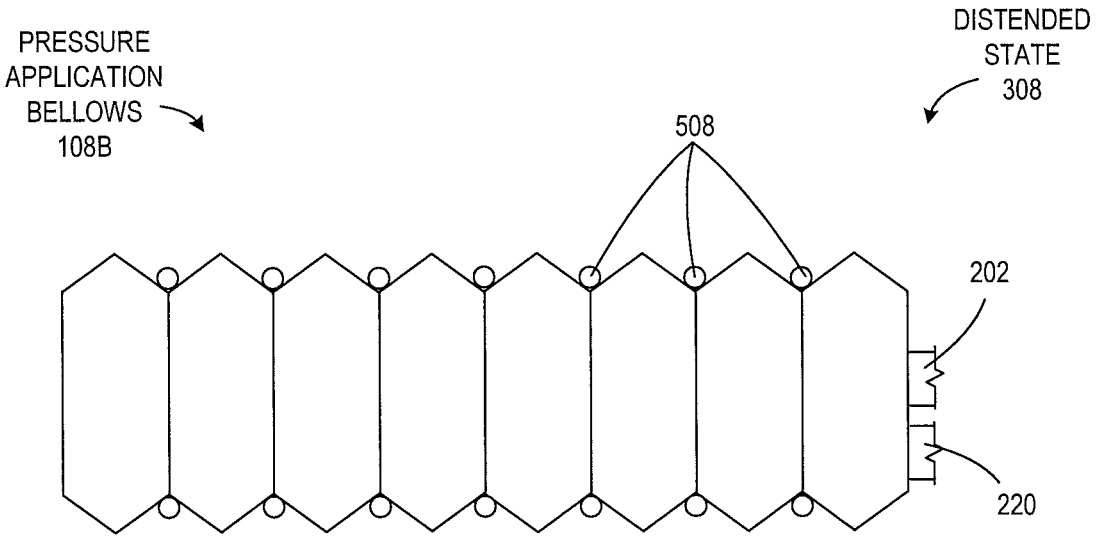

Means 508 for retracting pressure-application bellows 108B from the longitudinal dimension $P_{max}$ to the longitudinal dimension $P_{min}$ may include a spring encompassing the concertinaed sides of the pressure-application bellows 108B and biased to the collapsed state 304 (FIG. 6A). Upon expansion of pressure-application bellows 108B to distended state 308 (FIG. 6B), the spring stretches, creating a retraction force that, upon release of the air within internal space 212 of pressure-application bellows 108B via relief outlet 220, returns pressure-application bellows 108B to collapsed state 304. The spring may be a coil spring, one or more conical or undulating washers, such as a Belleville washer, or still another mechanical, metallic, or resilient elastomeric spring arrangement. Alternatively, instead of or in addition to the spring, the means 508 may include a gas spring or a magnetic repulsion arrangement. The means 508 may include an active or powered element, such as a solenoid device, or electromagnetic field, pressurized fluid, or a finger, lever, gear, wedge, or other mechanical element moved under power to retract the pressure-application bellows 108B to the longitudinal dimension $P_{min}$.

Figure 7A:
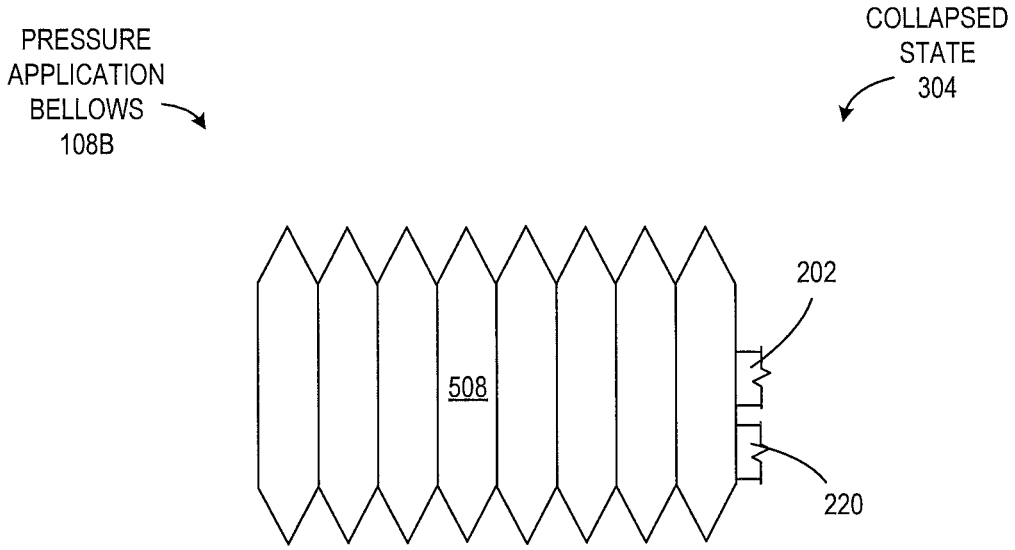
Figure 7B:
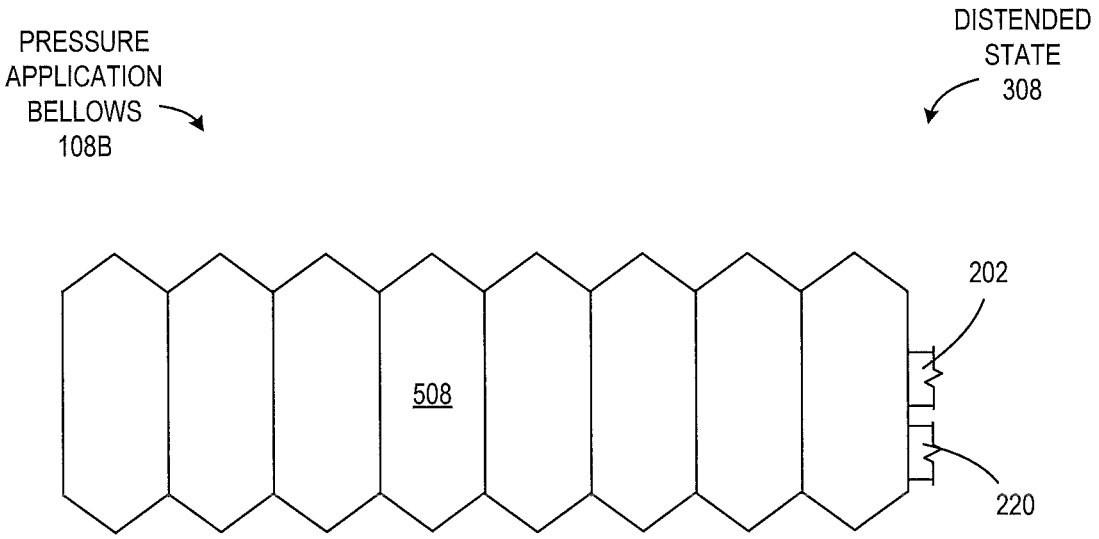

Moreover, the means 508 may alternatively include resilient material forming the pressure-application bellows 108B such that the resilient material is biased in the collapsed state 304 (FIG. 7A). Upon expansion of pressure-application bellows 108B to distended state 308 (FIG. 7B), the resilient material stretches, creating a retraction force that, upon release of the air within internal space 212 of pressure-application bellows 108B via relief outlet 220, returns pressure-application bellows 108B to collapsed state 304. The resilient material may include an elastomer, a stretch fabric or synthetic fabric such as spandex, neoprene, elastane, polyurethane, nylon, Teflon coated fiberglass, hypalon coated nylon, or neoprene coated nylon.

Figure 8A:
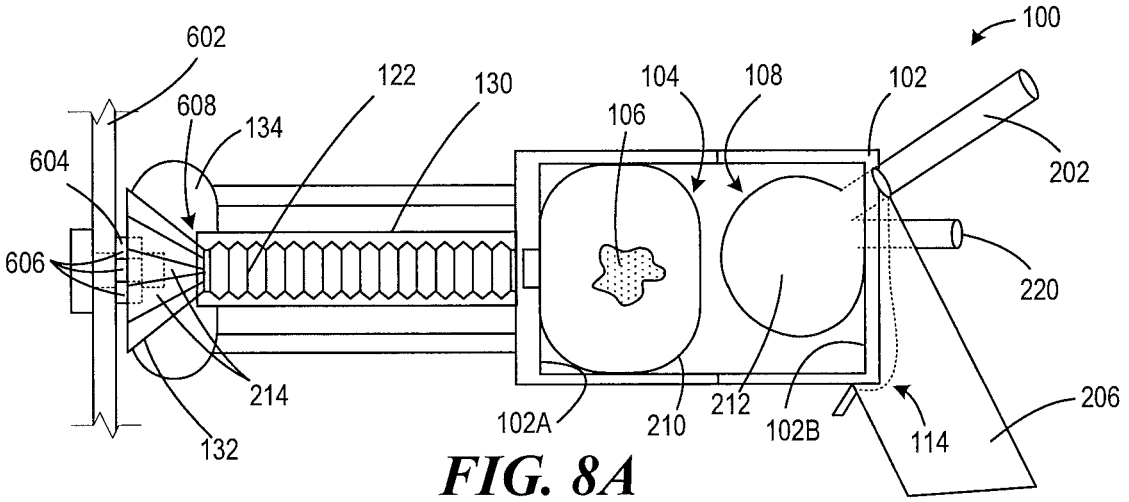
Figure 8B:
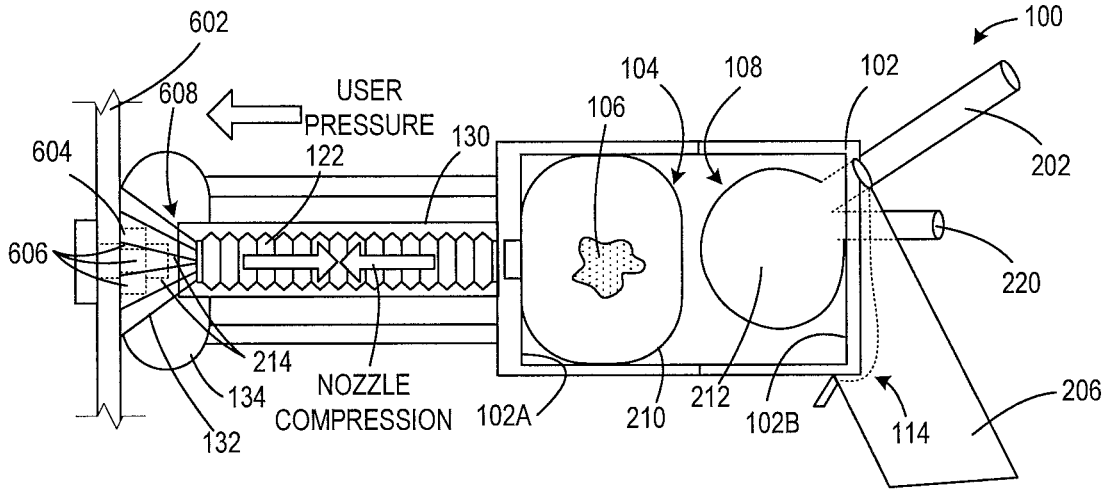
Figure 8C:
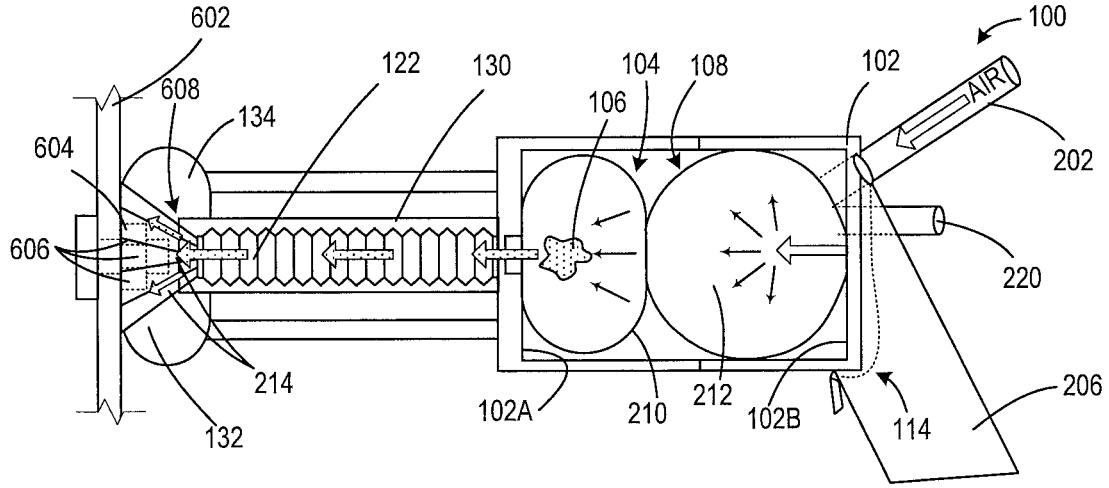

Referring generally to FIGS. 1, 2A-2D, 6A, 6B, 7A, 7B and particularly to e.g. FIGS. 8A-8C, the instant paragraph pertains to example 7 of the present disclosure. In example 7, which includes the subject matter of any of examples 5-6, daubing device 100 further comprises air inlet 202 capable of being in fluid communication with internal space 212 within pressure-application bellows 108B. Daubing device 100 also comprises activation mechanism 114 capable of selectively enabling fluid communication between air inlet 202 and internal space 212 within pressure-application bellows 108B.

Air inlet 202 may include any tube, conduit, or pathway allowing for fluid communication between an external air source and internal space 212 of pressure-application bellows 108B. According to one example, air inlet 202 includes a quick-disconnect fitting as conventionally used for connecting pneumatic equipment to a compressed air source. Activation mechanism 114 may be any mechanical or electromechanical mechanism that selectively opens and closes the air pathway from an external air source to internal space 212 via air inlet 202. For example, activation mechanism 114 may include a finger-operated trigger that is electrically and/or mechanically connected to a valve that operates in response to pulling the trigger to open air inlet 202 (FIG. 8C) to allow for external air to flow into internal space 212 and expand pressure-application device 108, and in response to releasing the trigger to close air inlet 202 to prevent external air from flowing through air inlet 202 and prevent further expansion.

Referring generally to FIGS. 1 and 3A-3C, and particularly to e.g. FIGS. 2A and 2B, the instant paragraph pertains to example 8 of the present disclosure. In example 8, which includes the subject matter of any of examples 2-4, pressure-application device 108 comprises balloon mechanism 108A expandable from longitudinal dimension $P_{min}$ to longitudinal dimension $P_{max}$.

According to this example, balloon mechanism 108A is expandable within housing 102. Balloon mechanism 108A may not only expand linearly like pressure-application bellows 108B describe above, but also three-dimensionally. However, because balloon mechanism 108A is constrained by the walls of housing 102, balloon mechanism 108A expands linearly away from second internal face 102B, applying a force against flexible wall 210 of dispenser 104 to compress dispenser 104 against first internal face 102A and expel viscous material 106 (FIGS. 2A, 2B).

Referring generally to FIGS. 1, 2A, and 2B, and particularly to e.g. FIGS. 8A-8C, the instant paragraph pertains to example 9 of the present disclosure. In example 9, which includes the subject matter of example 8, balloon mechanism 108A comprises balloon walls 250 that are flexible.

As described above, balloon mechanism 108A expands in three-dimensions, filling housing 102 and compressing dispenser 104. This three-dimensional expansion is provided for by balloon walls 250 being flexible. As used herein, "flexible" means non-rigid. A flexible wall is one that may be capable of bending easily without breaking. A flexible wall may or may not be stretchable or resilient.

Referring generally to FIGS. 1, 2A, and 2B, and particularly to e.g. FIGS. 8A-8C, the instant paragraph pertains to example 10 of the present disclosure. In example 10, which includes the subject matter of example 9, balloon walls 250 are stretchable.

As used herein, "stretchable" means resilient or capable of recoiling or springing back into shape after bending or stretching. This characteristic allows the balloon mechanism 108A to return to the longitudinal dimension $P_{min}$ after expanding, releasing air from internal space 212 through relief outlet 220. In doing so, balloon mechanism 108A is prepared for further expansion during a subsequent use.

Referring generally to FIGS. 1, 2A-2D, 6A, 6B, 7A, 7B and particularly to e.g. FIGS. 8A-8C, the instant paragraph pertains to example 11 of the present disclosure. In example 11, which includes the subject matter of any of examples 8-10, daubing device 100 further comprises air inlet 202 capable of being in fluid communication with internal space 212 within balloon mechanism 108A. Daubing device 100 also comprises activation mechanism 114 capable of selectively enabling fluid communication between air inlet 202 and internal space 212 within balloon mechanism 108A.

As previously described, air inlet 202 provides a pathway between an external air source and internal space 212 of pressure-application device 108. According to this example, air inlet 202 provides fluid communication with internal space 212 of balloon mechanism 108A upon activation of activation mechanism 114. Activation mechanism 114 may be any mechanical or electromechanical mechanism that selectively opens and closes the air pathway from an external air source to internal space 212 via air inlet 202.

Referring generally to FIG. 1 and particularly to e.g. FIGS. 2A and 2C, the instant paragraph pertains to example 12 of the present disclosure. In example 12, which includes the subject matter of any of examples 2-11, dispenser 104 comprises pouch 104A.

Pouch 104A may include one or more pouch walls 240 that are flexible. In this example, flexible wall 210 may include all pouch walls 240 so that the entire surface of pouch 104A is collapsible. Alternatively, pouch walls 240 may include a single wall adjacent to pressure-application device 108 that is flexible wall 210.

Referring generally to FIG. 1 and particularly to e.g. FIGS. 2A and 2C, the instant paragraph pertains to example 13 of the present disclosure. In example 13, which includes the subject matter of example 12, pouch 104A comprises pouch walls 240 that are flexible and not stretchable.

According to one example, pouch walls 240 are flexible in that they may bend and collapse or compress. However, according to this example, pouch walls 240 are not stretchable in that they do not return to an original shape when compressed.

Referring generally to FIG. 1 and particularly to e.g. FIGS. 2B and 2D, the instant paragraph pertains to example 14 of the present disclosure. In example 14, which includes the subject matter of any of examples 2-11, dispenser 104 comprises dispenser bellows 104B.

According to this example, dispenser bellows 104B is linearly compressible within housing 102. By linearly compressing toward the fixed first internal face 102A, dispenser bellows 104B is compressed to expel viscous material 106.

Referring generally to FIGS. 1 and 2A-2D, and particularly to e.g. FIGS. 4A, 4B, 5A, 5B, and 8A-8C, the instant paragraph pertains to example 15 of the present disclosure. In example 15, which includes the subject matter of any of examples 1-14, daubing device 100 further comprises nozzle 122 in fluid communication with dispenser 104. Nozzle 122 has an adjustable length.

According to one example, nozzle 122 is coupled at nozzle inlet 124 to dispenser 104 via coupling mechanism 208. Coupling mechanism 208 may include threads or any other mechanism for mechanically coupling nozzle 122 to dispenser 104. Nozzle 122 and dispenser 104 are in fluid communication with one another to allow a pathway for viscous material 106 from dispenser 104 through nozzle outlet 128 of nozzle 122.

Referring generally to FIG. 1 and particularly to e.g. FIGS. 2A-2D, the instant paragraph pertains to example 16 of the present disclosure. In example 16, which includes the subject matter of example 15, nozzle 122 is detachable from dispenser 104.

As discussed, coupling mechanism 208 may include threads or any other mechanism for mechanically coupling nozzle 122 to dispenser 104. According to this example, coupling mechanism 208 allows nozzle 122 to be detachable. In doing so, nozzle 122 may be detached for removal of dispenser 104 when empty and reattached to a full dispenser 104.

Referring generally to FIGS. 1 and 2A-2D and particularly to e.g. FIGS. 4A, 4B, 5A, and 5B, the instant paragraph pertains to example 17 of the present disclosure. In example 17, which includes the subject matter of any of examples 15-16, nozzle 122 comprises nozzle inlet 124, nozzle bellows 126, and nozzle outlet 128.

Nozzle inlet 124 is attached to dispenser 104 at one end of nozzle bellows 126. Nozzle outlet 128 is positioned at an end of nozzle bellows 126 opposite nozzle inlet 124. Nozzle bellows 126 defines a linearly expandable and compressible pathway for viscous material 106 from nozzle inlet 124 to nozzle outlet 126.

Referring generally to FIG. 1 and particularly to e.g. FIGS. 4A, 4B, 5A and 5B, the instant paragraph pertains to example 18 of the present disclosure. In example 18, which includes the subject matter of example 17, daubing device 100 further comprises means 408 for expanding nozzle bellows 126 from compressed configuration 406 to distended configuration 404.

Figure 4A:
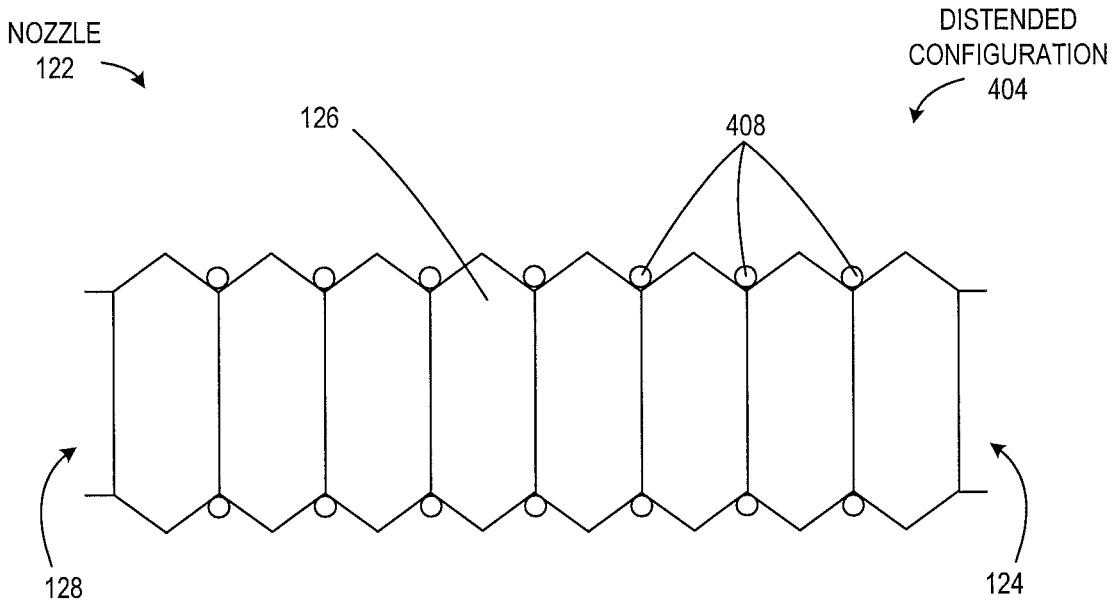
Figure 4B:
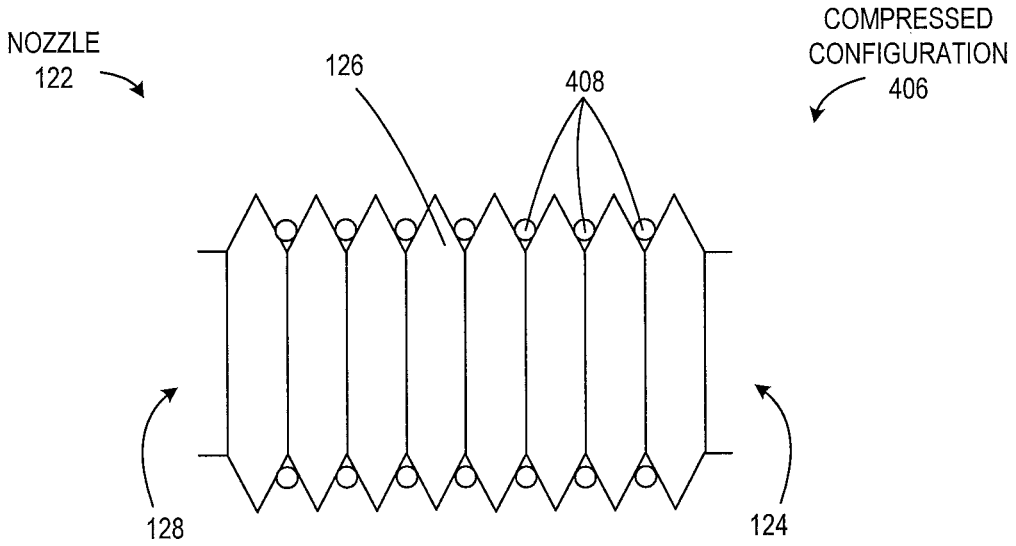

Means 408 for expanding nozzle bellows 126 from compressed configuration 406 to distended configuration 404 may include a spring encompassing the concertinaed sides of the nozzle bellows 126 and biased to distended configuration 404 (FIG. 4A). Upon compression of nozzle bellows 126 to compressed configuration 406 (FIG. 4B), the spring compresses, creating an expansion force that, upon release of user-applied pressure to aligner 132, returns nozzle bellows 126 to distended configuration 404. The spring may be a coil spring, one or more conical or undulating washers, such as a Belleville washer, or still another mechanical, metallic, or resilient elastomeric spring arrangement. Alternatively, instead of or in addition to the spring, the means 408 may include a gas spring or a magnetic repulsion arrangement. The means 408 may include an active or powered element, such as a solenoid device, or electromagnetic field, pressurized fluid, or a finger, lever, gear, wedge, or other mechanical element moved under power to extend the nozzle bellows 126 to the distended configuration 404.

Figure 5A:
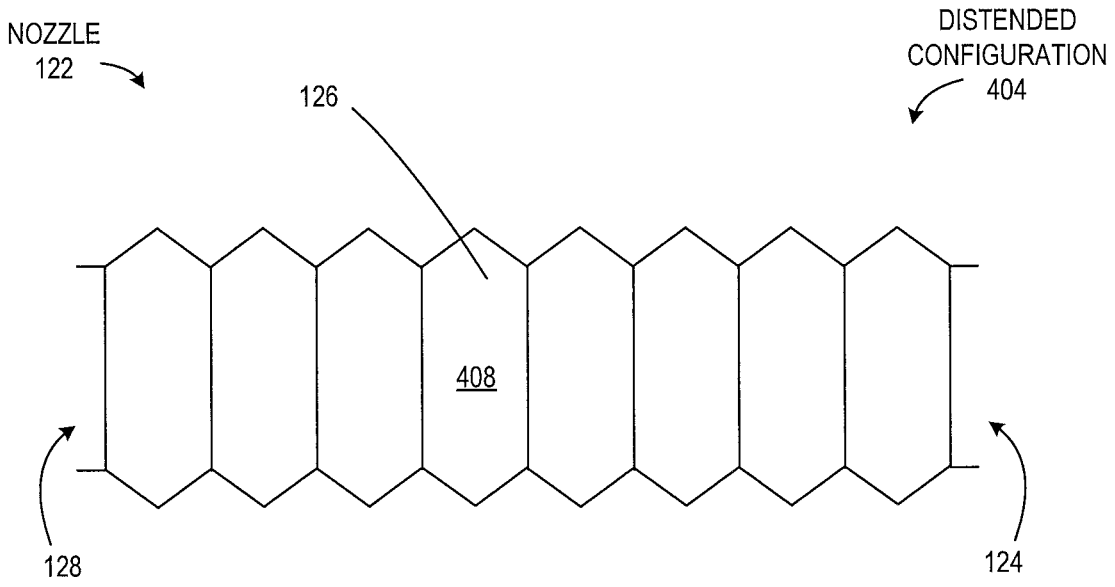
Figure 5B:
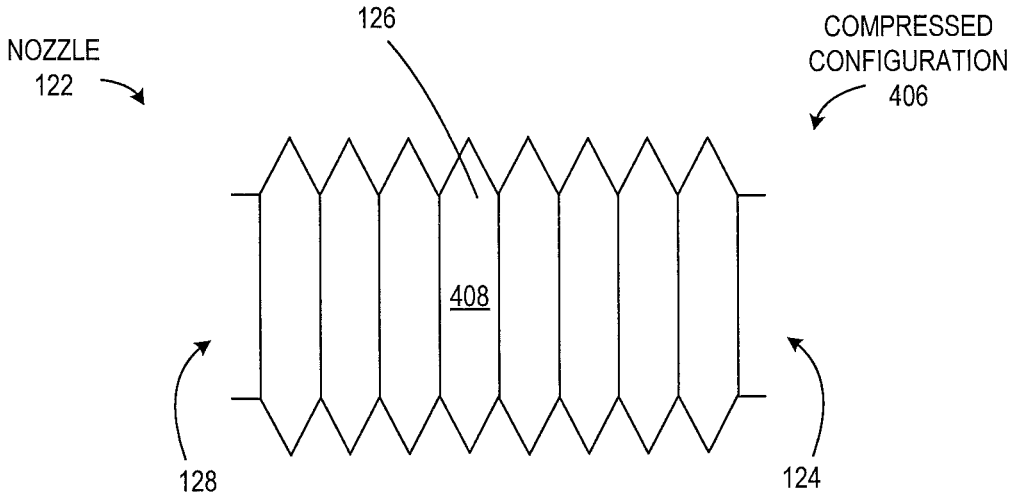

Moreover, the means 408 may alternatively include resilient material forming the nozzle bellows 126 such that the resilient material is biased in the distended configuration 404 (FIG. 5A). Upon compression of nozzle bellows 126 to compressed configuration 406 (FIG. 5B), the resilient material compresses, creating an expansion force that, upon release of the user-applied pressure to aligner 132, returns nozzle bellows 126 to distended configuration 404. The resilient material may include an elastomer, a stretch fabric or synthetic fabric such as spandex, neoprene, elastane, polyurethane, nylon, Teflon coated fiberglass, hypalon coated nylon, or neoprene coated nylon.

Referring generally to FIGS. 1 and 2A-2D, and particularly to e.g. FIGS. 8A-8C, the instant paragraph pertains to example 19 of the present disclosure. In example 19, which includes the subject matter of any of examples 17-18, daubing device 100 further comprises biasing tube 130 attached to housing 102. Nozzle 122 is inside biasing tube 130 and is movable relative to biasing tube 130.

According to one example, biasing tube 130 is rigid and attached at one end to housing 102, with aligner end 608 opposite the housing 102. Biasing tube 130 has a diameter larger than a diameter of nozzle 122 and encompasses nozzle bellows 126.

Referring generally to FIGS. 1 and 2A-2D, and particularly to e.g. FIGS. 8A-8C, the instant paragraph pertains to example 20 of the present disclosure. In example 20, which includes the subject matter of example 19, daubing device 100 further comprises aligner 132 attached to nozzle outlet 128. Aligner 132 is sized to engage one or more outer surfaces 606 of fastener 604 and comprises surfaces 214 that contact biasing tube 130 and diverge radially outward from nozzle outlet 128 with nozzle bellows 126 in distended configuration 404.

According to this example, aligner 132 is attached to nozzle outlet 128 so that it is linearly moveable with the nozzle outlet 128 along an axis extending centrally through nozzle bellows 126. Aligner 132 includes surfaces 214 that diverge radially outward from nozzle outlet 128 when nozzle bellows 126 is in distended configuration 404. When nozzle 126 is in the compressed configuration 406, or at some location while moving from distended configuration 404 to compressed configuration 406, surfaces 214 of aligner 132 contact aligner end 608 of biasing tube 130. Upon further compression of nozzle 126, aligner end 608 of biasing tube 130 squeezes or otherwise forces surfaces 214 of aligner to close inwardly toward the axis extending centrally through nozzle bellows 126 to engage one or more outer surfaces 606 of fastener 604 to ensure proper centering and alignment prior to application of viscous material 106. Aligner 132 additionally ensures that the proper dimensions of viscous material 106 is applied over fastener 604.

Referring generally to FIGS. 8A-8C and particularly to e.g. FIGS. 2A-2D, the instant paragraph pertains to example 21 of the present disclosure. In example 21, which includes the subject matter of example 20, surfaces 214 are longitudinally interconnected.

Surfaces 214 of aligner 132 are longitudinally interconnected at nozzle outlet 128. In other words, each surface 214 abuts at least one other surface at the end that is attached to nozzle outlet 128.

Referring generally to FIG. 1 and particularly to e.g. FIGS. 2A-2D, the instant paragraph pertains to example 22 of the present disclosure. In example 22, which includes the subject matter of any of examples 20-21, daubing device 100 further comprises agitator 134 vibrationally coupled to aligner 132.

According to this example, agitator 134 is vibrationally coupled to aligner 132. Agitator 134 is a device that is capable of producing vibrations. Being vibrationally coupled to aligner 132 means that agitator 134 is coupled to aligner 132 or to any portion of daubing device 100 in which vibrations from agitator 134 are transmitted to aligner 132. The vibrations from agitator 134 facilitate separation of viscous material 106 from aligner 132 after viscous material 106 has been distributed around fastener 604. The shape, configuration, and positioning of agitator 134 is not limited to the depiction of agitator 134 shown in the figures.

Referring generally to FIG. 1 and particularly to e.g. FIGS. 2A-2D, the instant paragraph pertains to example 23 of the present disclosure. In example 23, which includes the subject matter of example 22, agitator 134 is capable of selectively transmitting ultrasonic energy to aligner 132.

According to this example, agitator 134 transmits ultrasonic energy to aligner 132. The ultrasonic energy facilitates separation of viscous material 106 from aligner 132. Agitator 134 will have a power source (not shown) for operation and may be selectively activated and deactivated. According to one example, activation mechanism 114 operates to activate agitator 134 during dispensing of viscous material 106. A piezoelectric actuator may provide a source of power for agitator 134 to transmit ultrasonic energy to aligner 132.

Referring generally to FIGS. 8A-8C and particularly to e.g. FIG. 9, the instant paragraph pertains to example 24 of the present disclosure. Example 24 relates to method 900 for applying viscous material 106 to fastener 604. Method 900 comprises deforming flexible wall 210 of dispenser 104 located within housing 102 by expanding pressure-application device 108 within housing 102 (block 902). Method 900 further comprises expelling viscous material 106 from dispenser 104 responsive to deforming flexible wall 210 of dispenser 104 located within housing 102 (block 904).

Various examples may be described with general reference to FIGS. 8A-8C, which depict daubing gun 100 prior to application of viscous material 106 over fastener 604 in structure 602 (FIG. 8A), during alignment over fastener 604 and compression of nozzle 122 (FIG. 8B), and during application of viscous material 106 from dispenser 104, through nozzle 126, and around fastener 604 (FIG. 8C). According to example 24, deforming flexible wall 210 of dispenser 104 by expanding pressure-application device 108 within housing 102 (block 902) allows for compression of dispenser 104 and subsequent expelling of viscous material 106 from dispenser 104 (block 904) without introducing air into viscous material 106. Conventional daubing devices may input external air directly into the viscous material 106 to force it out of the daubing device. Doing so creates significant opportunities to trap air bubbles inside of the viscous material 106, creating voids upon curing. In contrast, by utilizing pressure-application device 108 to deform flexible wall 210 of dispenser 104 in order to expel the viscous material 106 according to this example, the external air cannot come into contact with the viscous material 106, which prevents air bubbles and resulting voids in the cured viscous material 106 around fastener 604. Preventing air bubbles and associated voids in the cured viscous material 106 significantly reduces the time required to correct these deficiencies that are prevalent with conventional daubing methods.

Still referring generally to FIGS. 1 and 8A-8C and particularly to e.g. FIG. 9, the instant paragraph pertains to example 25 of the present disclosure. In example 25, which includes the subject matter of example 24, pressure-application device 108 comprises balloon mechanism 108A. Expanding pressure-application device 108 within housing 102 (block 902) comprises inflating balloon mechanism 108A with a fluid (block 902A).

According to this example, pressure-application device 108 comprises balloon mechanism 108A (FIGS. 2A, 2B). Expansion of balloon mechanism 108A comprises inflating balloon mechanism 108A with a fluid, e.g. external air (block 902A). FIG. 8C depicts the expansion of pressure-application device 108, such as balloon mechanism 108A, through inflation with air via air inlet 202. Alternatively, balloon mechanism 108A could be filled with any other type of fluid, including but not limited to water, oil, hydraulic fluid, or any other type of gas or liquid. According to alternative examples in which the fluid comprises a liquid, air inlet 202 and relief outlet 220 may include input and output ports, respectively, that are fluidly coupled to a pump operative to pump the fluid into pressure-application device 108 to expand pressure-application device 108 and compress dispenser 104, and to pump the fluid out of pressure-application device 108 to release the pressure of pressure-application device 108 from dispenser 104.

Still referring generally to FIGS. 1, 2C, 2D, 6A, 6B, 7A, and 7B and particularly to e.g. FIG. 9, the instant paragraph pertains to example 26 of the present disclosure. In example 26, which includes the subject matter of example 24, pressure-application device 108 comprises pressure-application bellows 108B that is linearly expandable. Expanding pressure-application device 108 within housing 102 (block 902) comprises inflating pressure-application bellows 108B with a fluid (block 902B).

According to this example, pressure-application device 108 comprises pressure-application bellows 108B (FIGS. 2C, 2D). Expansion of pressure-application bellows 108B comprises inflating pressure-application bellows 108B with a fluid, e.g. external air (block 902B). When fluid is input into pressure-application bellows 108B via air inlet 202, pressure-application bellows 108B linearly expands along a central axis from collapsed state 304 (FIGS. 6A, 7A) to distended state 308 (FIGS. 6B, 7B) to apply pressure to dispenser 104.

Still referring generally to FIGS. 1, 2A, 2C, and 8A-8C and particularly to e.g. FIG. 9, the instant paragraph pertains to example 27 of the present disclosure. In example 27, which includes the subject matter of any of examples 24-26, dispenser 104 comprises pouch 104A. Expelling viscous material 106 from dispenser 104 located within housing 102 (block 904) comprises collapsing pouch 104A by deforming flexible wall 210 of pouch 104A responsive to expanding pressure-application device 108 within housing 102 (block 904A).

According to this example, dispenser 104 comprises pouch 104A (FIGS. 2A, 2C). When pressure-application device 108 expands within housing 102 (FIG. 8C, block 902), pouch 104A collapses to expel viscous material 106 (FIG. 8C, block 904A). By having pouch 104A with flexible wall 210, any force applied to pouch 104A within the rigid constraints of the walls of housing 102 will cause flexible wall 210 to deform and collapse (block 904A), efficiently expelling viscous material 106 from dispenser 104 without introducing air directly into viscous material 106.

Still referring generally to FIGS. 1, 2B, and 2D, and particularly to e.g. FIG. 9, the instant paragraph pertains to example 28 of the present disclosure. In example 28, which includes the subject matter of any of examples 24-26, dispenser 104 comprises dispenser bellows 104B (FIGS. 1, 2B, and 2D). Expelling viscous material 106 from dispenser 104 located within housing 102 (block 904) comprises linearly compressing dispenser bellows 104B by deforming flexible wall 210 of dispenser bellows 104B responsive to expanding pressure-application device 108 within housing 102 (block 904B).

According to this example, dispenser 104 comprises dispenser bellows 104B (FIGS. 1, 2B, 2D). When pressure-application device 108 expands within housing 102 (block 902), dispenser bellows 104B collapses to expel viscous material 106 (block 904B). By having dispenser bellows 104B with flexible walls 210, any force applied to dispenser bellows 104B within the rigid constraints of the walls of housing 102 will cause flexible walls 210 of dispenser bellows 104B to deform and linearly collapse (block 904B), efficiently expelling viscous material 106 from dispenser 104 without introducing air directly into viscous material 106.

Still referring generally to FIGS. 8A-8C and particularly to e.g. FIG. 9, the instant paragraph pertains to example 29 of the present disclosure. In example 29, which includes the subject matter of any of examples 24-28, the method 900 further comprises aligning nozzle 122 relative to fastener 604 by engaging aligner 132 coupled to nozzle 122 with fastener 604 (block 906). Nozzle 122 is in fluid communication with dispenser 104 and is located inside biasing tube 130, coupled to housing 102 (FIGS. 8A-8C).

According to this example, aligner 132 allows a user to efficiently align daubing device 100 and corresponding nozzle 122 with fastener 604 for dispensing viscous material 106 around fastener 604 (FIG. 8A).

Still referring generally to FIGS. 8A-8C and particularly to e.g. FIG. 9, the instant paragraph pertains to example 30 of the present disclosure. In example 30, which includes the subject matter of example 29, engaging aligner 132 with fastener 604 (block 906) comprises positioning aligner 132 over fastener 604 (block 906A), and advancing biasing tube 130 toward fastener 604 to establish contact between aligner 132 and structure 602 through which fastener 604 is secured to partially retract aligner 132 into biasing tube 130 until a plurality of surfaces 214 of aligner 132 contact one or more outer surfaces 606 of fastener 604 (block 906B).

FIG. 8A shows this example of positioning aligner 132 over fastener 604. FIG. 8B shows illustrates a user advancing biasing tube 130 toward fastener 604 to establish contact between aligner 132 and structure 602. As seen in FIG. 8C, aligner is partially retracted into biasing tube 103 until surfaces 214 of aligner 132 contact outer surfaces 606 of fastener 604. This engagement of aligner 132 with fastener 604 ensures proper centering and alignment of daubing gun 100, and specifically of nozzle 122, with respect to fastener 604 to provide optimal distribution of viscous material 106.

Still referring generally to FIGS. 4A, 4B, 5A, 5B, 8B, and 8C and particularly to e.g. FIG. 9, the instant paragraph pertains to example 31 of the present disclosure. In example 31, which includes the subject matter of example 30, partially retracting aligner 132 into biasing tube 130 (block 906B) comprises compressing nozzle 122 lengthwise (block 906C).

According to this example, aligner 132 is attached to nozzle outlet 128 so that it is linearly moveable with the nozzle outlet 128 along an axis extending centrally through nozzle bellows 126. Biasing tube 130 is rigid and attached at one end to housing 102, with aligner end 608 opposite the housing 102. When nozzle 126 is moving from distended configuration 404 to compressed configuration 406 (FIGS. 4A, 4B, 5A, 5B, 8B), nozzle 122 is being compressed lengthwise. As a result, surfaces 214 of aligner 132 contact aligner end 608 of biasing tube 130. Upon further compression of nozzle 126, aligner end 608 of biasing tube 130 squeezes or otherwise forces surfaces 214 of aligner to close inwardly toward the axis extending centrally through nozzle bellows 126 to engage one or more outer surfaces 606 of fastener 604 to ensure proper centering and alignment prior to application of viscous material 106.

Referring e.g., to FIGS. 1, 2A-2D, and 8A-8C, the instant paragraph pertains to example 32 of the present disclosure. Example 32 relates to an aircraft comprising fastener 604. Viscous material 106 is applied over fastener 604 according to any of examples 24-31.

Examples of the present disclosure may be described in the context of aircraft manufacturing and service method 1100 as shown in FIG. 10 and aircraft 1102 as shown in FIG. 11. During pre-production, illustrative method 1100 may include specification and design (block 1104) of aircraft 1102 and material procurement (block 1106). During production, component and subassembly manufacturing (block 1108) and system integration (block 1110) of aircraft 1102 may take place. Thereafter, aircraft 1102 may go through certification and delivery (block 1112) to be placed in service (block 1114). While in service, aircraft 1102 may be scheduled for routine maintenance and service (block 1116). Routine maintenance and service may include modification, reconfiguration, refurbishment, etc. of one or more systems of aircraft 1102.

Each of the processes of illustrative method 1100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 11, aircraft 1102 produced by illustrative method 1100 may include airframe 1118 with a plurality of high-level systems 1120 and interior 1122. Examples of high-level systems 1120 include one or more of propulsion system 1124, electrical system 1126, hydraulic system 1128, and environmental system 1130. Any number of other systems may be included. Although an aerospace example is shown, the principles disclosed herein may be applied to other industries, such as the automotive industry. Accordingly, in addition to aircraft 1102, the principles disclosed herein may apply to other vehicles, e.g., land vehicles, marine vehicles, space vehicles, etc.

Apparatus(es) and method(s) shown or described herein may be employed during any one or more of the stages of the manufacturing and service method 1100. For example, components or subassemblies corresponding to component and subassembly manufacturing 1108 may be fabricated or manufactured in a manner similar to components or subassemblies produced while aircraft 1102 is in service. Also, one or more examples of the apparatus(es), method(s), or combination thereof may be utilized during production stages 1108 and 1110, for example, by substantially expediting assembly of or reducing the cost of aircraft 1102. Similarly, one or more examples of the apparatus or method realizations, or a combination thereof, may be utilized, for example and without limitation, while aircraft 1102 is in service, e.g., maintenance and service stage (block 1116).

Different examples of the apparatus(es) and method(s) disclosed herein include a variety of components, features, and functionalities. It should be understood that the various examples of the apparatus(es) and method(s) disclosed herein may include any of the components, features, and functionalities of any of the other examples of the apparatus (es) and method(s) disclosed herein in any combination, and all of such possibilities are intended to be within the spirit and scope of the present disclosure.

Many modifications of examples set forth herein will come to mind to one skilled in the art to which the present disclosure pertains having the benefit of the teachings presented in the foregoing descriptions and the associated drawings.

Therefore, it is to be understood that the present disclosure is not to be limited to the specific examples presented and that modifications and other examples are intended to be included within the scope of the appended claims. Moreover, although the foregoing description and the associated drawings describe examples of the present disclosure in the context of certain illustrative combinations of elements and/or functions, it should be appreciated that different combinations of elements and/or functions may be provided by alternative implementations without departing from the scope of the appended claims.

What is claimed is:

1. A method of applying a viscous material to a fastener, the method comprising:

aligning a nozzle relative to the fastener by engaging an aligner, coupled to the nozzle, with the fastener, wherein the nozzle is located inside a biasing tube, coupled to a housing, and wherein engaging the aligner with the fastener comprises:

positioning the aligner over the fastener; and advancing the biasing tube toward the fastener to establish contact between the aligner and a structure, through which the fastener is secured, to partially retract the aligner into the biasing tube until a plurality of surfaces of the aligner contacts one or more outer surfaces of the fastener;

deforming a flexible wall of a dispenser bellows located within the housing by expanding a pressure-application device, which is disposed within the housing and is configured to apply pressure on the flexible wall of the dispenser bellows, wherein the dispenser bellows is in fluid communication with the nozzle; and expelling the viscous material from the dispenser bellows responsive to deforming the flexible wall.

2. The method of claim 1, wherein the pressure-application device comprises a balloon mechanism, and wherein expanding the pressure-application device within the housing comprises inflating the balloon mechanism with a fluid.

3. The method of claim 1, wherein the pressure-application device comprises a pressure-application bellows that is linearly expandable, and wherein expanding the pressure-application device within the housing comprises inflating the pressure-application bellows with a fluid.

4. The method of claim 1, wherein expelling the viscous material from the dispenser bellows located within the housing comprises linearly compressing the dispenser bellows by deforming the flexible wall of the dispenser bellows responsive to expanding the pressure-application device within the housing.

5. The method of claim 1, wherein partially retracting the aligner into the biasing tube comprises compressing the nozzle lengthwise.

6. The method of claim 1, further comprising vibrationally agitating the aligner.

7. The method of claim 6, wherein vibrationally agitating the aligner comprises transmitting ultrasonic energy to the aligner.

8. A method of applying a viscous material to a fastener, the method comprising:

aligning a nozzle of a daubing device relative to the fastener by engaging an aligner, coupled to the nozzle, with the fastener, wherein engaging the aligner with the fastener comprises:

positioning the aligner over the fastener; and establishing contact between the aligner and a structure, through which the fastener is secured, to partially retract the aligner until a plurality of surfaces of the aligner contacts one or more outer surfaces of the fastener;

deforming a flexible wall of a dispenser bellows, located within a housing of the daubing device and in fluid communication with the nozzle, by expanding a pressure-application device, the pressure-application device being disposed within the housing and being configured to apply pressure on the flexible wall of the dispenser bellows; and expelling the viscous material from the dispenser bellows and through the nozzle responsive to deforming the flexible wall.

9. The method of claim 8, wherein partially retracting the aligner comprises compressing the nozzle lengthwise.

10. The method of claim 8, further comprising vibrationally agitating the aligner.

11. The method of claim 10, wherein vibrationally agitating the aligner comprises transmitting ultrasonic energy to the aligner.

12. The method of claim 8, wherein the pressure-application device comprises a balloon mechanism, and wherein expanding the pressure-application device within the housing comprises inflating the balloon mechanism with a fluid.

13. The method of claim 8, wherein the pressure-application device comprises a pressure-application bellows that is linearly expandable, and wherein expanding the pressure-application device within the housing comprises inflating the pressure-application bellows with a fluid.

14. The method of claim 8, wherein expelling the viscous material from the dispenser bellows located within the housing comprises linearly compressing the dispenser bellows by deforming the flexible wall of the dispenser bellows responsive to expanding the pressure-application device within the housing.

15. A method of applying a viscous material to a fastener, the method comprising:

aligning a nozzle of a daubing device relative to the fastener by engaging an aligner, coupled to the nozzle, with the fastener, wherein the nozzle is located inside a biasing tube coupled to a housing of the daubing device;

deforming a flexible wall of a dispenser bellows, located within the housing and in fluid communication with the nozzle, by expanding a pressure-application device, the pressure-application device being disposed within the housing and being configured to apply pressure on the flexible wall of the dispenser bellows;

expelling the viscous material from the dispenser bellows and through the nozzle responsive to deforming the flexible wall; and vibrationally agitating the aligner.

16. The method of claim 15, wherein engaging the aligner with the fastener comprises:

positioning the aligner over the fastener; and advancing the biasing tube toward the fastener to establish contact between the aligner and a structure through which the fastener is secured to partially retract the aligner into the biasing tube until a plurality of surfaces of the aligner contacts one or more outer surfaces of the fastener.

17. The method of claim 16, wherein partially retracting the aligner into the biasing tube comprises compressing the nozzle lengthwise.

18. The method of claim 15, wherein vibrationally agitating the aligner comprises transmitting ultrasonic energy to the aligner.

19. The method of claim 15, wherein:

the pressure-application device comprises a balloon mechanism, and expanding the pressure-application device within the housing comprises inflating the balloon mechanism with a fluid.

20. The method of claim 15, wherein:

the pressure-application device comprises a pressure-application bellows that is linearly expandable, and expanding the pressure-application device within the housing comprises inflating the pressure-application bellows with a fluid.

* * * * *